US011299693B2

(12) United States Patent
Watson

(10) Patent No.: US 11,299,693 B2
(45) **Date of Patent: *Apr. 12, 2022**

(54) HIGH PERFORMANCE DISHWASHER COMPOSITIONS

(71) Applicant: Korex Canada Company, Etobicoke (CA)

(72) Inventor: Douglas Robert Watson, Toronto (CA)

(73) Assignee: KOREX CANADA COMPANY, Etobicoke (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/984,691

(22) Filed: Aug. 4, 2020

(65) Prior Publication Data

US 2020/0362268 A1 Nov. 19, 2020

Related U.S. Application Data

(63) Continuation-in-part of application No. 16/202,958, filed on Nov. 28, 2018, now Pat. No. 10,767,140.

(60) Provisional application No. 62/592,081, filed on Nov. 29, 2017.

(51) Int. Cl.

| | |
|---|---|
| ***C11D 1/66*** | (2006.01) |
| ***C11D 3/22*** | (2006.01) |
| ***C11D 3/33*** | (2006.01) |
| ***C11D 3/37*** | (2006.01) |
| ***C11D 3/386*** | (2006.01) |
| ***C11D 17/00*** | (2006.01) |
| ***C11D 3/20*** | (2006.01) |
| ***C11D 3/04*** | (2006.01) |
| ***C11D 3/08*** | (2006.01) |
| ***C11D 3/10*** | (2006.01) |
| ***C11D 1/72*** | (2006.01) |
| ***C11D 11/00*** | (2006.01) |

(52) U.S. Cl.

CPC ..... *C11D 3/33* (2013.01); *C11D 1/72* (2013.01); *C11D 3/046* (2013.01); *C11D 3/08* (2013.01); *C11D 3/10* (2013.01); *C11D 3/2082* (2013.01); *C11D 3/2086* (2013.01); *C11D 3/222* (2013.01); *C11D 3/378* (2013.01); *C11D 3/3749* (2013.01); *C11D 3/3765* (2013.01); *C11D 3/3784* (2013.01); *C11D 3/38618* (2013.01); *C11D 11/0035* (2013.01); *C11D 17/0008* (2013.01)

(58) Field of Classification Search

CPC ..... C11D 1/66; C11D 3/2086; C11D 3/22; C11D 3/33; C11D 3/37; C11D 3/378; C11D 3/386; B08B 3/04

See application file for complete search history.

(56) References Cited

U.S. PATENT DOCUMENTS

| | | | | |
|---|---|---|---|---|
| 6,395,185 | B1 | 5/2002 | Gauthier et al. | |
| 6,835,703 | B1 | 12/2004 | Cho et al. | |
| 10,767,140 | B2 * | 9/2020 | Watson | C11D 3/08 |
| 2011/0009303 | A1 * | 1/2011 | Tsumori | C08L 35/00 510/223 |

FOREIGN PATENT DOCUMENTS

| | | | |
|---|---|---|---|
| EP | 2336284 | A2 | 6/2011 |

OTHER PUBLICATIONS

Amjad, et al., Factors Influencing the Precipitation of Calcium-Inhibitor Salts in Industrial Water Systems, 2007, 21 pages, The Lubrizol Corporation, US.

* cited by examiner

*Primary Examiner* — Brian P Mruk

(74) *Attorney, Agent, or Firm* — Dinsmore & Shohl LLP

(57) ABSTRACT

A dishwasher composition includes at least one strong chelant, at least one weak chelant, at least one surfactant, and at least one enzyme. The dishwasher composition can be a liquid or a gel and has a pH of from 7.0 to 9.5 and may contain less than 1 wt. % silicates based on the total weight of the dishwasher composition. Methods of washing articles include preparing a wash solution that includes water and the dishwasher composition, and contacting at least one article with the washing solution during at least a portion of a wash cycle of a commercially-available dishwasher.

20 Claims, No Drawings

HIGH PERFORMANCE DISHWASHER COMPOSITIONS

CROSS-REFERENCE TO RELATED APPLICATION

This application is a continuation-in-part of U.S. patent application Ser. No. 16/202,958, now U.S. Pat. No. 10,767,140, entitled "High Performance Dishwasher Compositions for Short Dishwasher Cycles and Methods to Manufacture," filed on Nov. 28, 2019, which claims the benefit of priority under 35 U.S.C. § 120 of U.S. Provisional Application No. 62/592,081, entitled "High Performance Dishwasher Compositions for Short Dishwasher Cycles and Methods to Manufacture," filed Nov. 29, 2017, the entire contents of which are hereby incorporated by reference.

TECHNICAL FIELD

The present disclosure is directed to dishwasher compositions, in particular dishwasher compositions providing high-performance cleaning while reducing scale formation.

BACKGROUND

There are currently numerous dishwasher liquid products on the market. Most of these commercially-available dishwasher liquid products use conventional alkaline chemistry (sodium silicate, sodium hydroxide, sodium carbonate) with sodium hypochlorite bleach and small amounts of polymers and specialty components. These commercially-available dishwasher liquid products can also generally include one or more of sodium silicate, sodium hydroxide, and sodium carbonate. A few enzymatic dishwashing products on the market are formulated to have a lower pH with various chelating agents, but these enzymatic dishwashing products may also include silicates and bicarbonates. However, none of these currently commercially-available dishwasher liquid products are designed to specifically address the problem of scale build-up (e.g., filming and spotting) on articles in the dishwasher, such as glass articles.

SUMMARY

Water used in dishwashers is often tap water, which can include salts of calcium and magnesium, such as calcium bicarbonate, magnesium bicarbonate, or other salts. The usage of tap water having high concentrations of calcium and magnesium salts can result in greater exposure of the articles in the dishwasher to these calcium and magnesium salts, which can lead to increased scale build-up. Repeated washings of glass articles conducted without any soil or commercially-available dishwasher product (e.g., detergent) can result in increased build-up of scale on the glass articles.

The problem is compounded with the addition of commercially-available dishwasher liquid/gel products that are highly alkaline in nature (e.g., highly alkaline referring to pH of greater than 9.5 or even greater than 10). Commercially-available dishwasher liquid/gel products that use highly alkaline chemistries having pH greater than 9.5 employ silicates, carbonates, bicarbonates, hydroxides, or any combination of these in the formulations. When testing using hard water in both normal wash cycles and shortened wash cycles, these commercially-available dishwasher liquid gel products result in precipitated, insoluble calcium carbonate ($CaCO_3$), other calcium (Ca) ion salts and complexes of poly-acrylate and modified poly-acrylate polymers on both glassware and plastic-ware. Multiple washes using these commercially-available dishwasher liquid/gel products leave heavy visible films, particularly on glassware, but also on plastic-ware or metal. The positive divalent calcium ion from the water source or intentionally added as part of one or more constituents of the commercially-available dishwasher liquid/gel products can also act as a bridge between foods soils and substrates that carry negative charge sites, such as by binding the food soils to the substrate through covalent or ionic bonds. Therefore, the presence of free calcium in the wash solution can adversely affect cleaning performance in general. Additionally, reaction products from reaction of the detergent constituents in the commercially-available dishwasher liquid/gel products and the water hardness (e.g., calcium ions, magnesium ions, and other mineral ions) can result in scale formation on dishes during the wash cycle.

Therefore, there is an ongoing need for dishwasher compositions that can reduce scale formation on dishes washed using hard water during normal and a shortened wash cycles. The present disclosure is directed to dishwasher compositions that include at least a strong chelant, a weak chelant, at least one surfactant, and at least one enzyme. The dishwasher compositions of the present disclosure can provide high-performance, meaning that the dishwasher compositions provide cleaning performance comparable to leading commercially-available products while also providing reduced scale deposits manifested in filming and spotting. The combination of chelants can reduce the free calcium concentration in the wash solution to improve cleaning performance by sequestering the free calcium as well as other mineral ions in the wash solution. The surfactant may emulsify grease, remove triglycerides, and reduce water surface tension and/or oil-in-water interfacial tension. The enzymes may remove proteins, starches, and other food soils from the articles being washed. The dishwasher compositions of the present disclosure can provide effective overall soil cleaning results and reduce scale build-up on glassware and plasticware during wash cycles. The dishwasher compositions may be a liquid or a gel and may be dispensed as a viscous pseudoplastic or thixotropic liquid from a bottle or other container. The dishwasher compositions may be effective for normal wash cycles and shortened dishwasher cycles (e.g., cycles less than 1.5 hours or less than or equal to 1 hour) across all water hardness levels. The dishwasher compositions are safer, less toxic, and exhibit reduced skin-irritation potential compared to commercially-available dishwasher liquid/gel products. Additionally, in embodiments, the dishwasher compositions may contain an effective preservative system to prevent spoilage from microbiological contamination. In embodiments, the dishwasher composition may include one or more detersive polymers. In embodiments, the detersive polymer may comprise monomers with sulphonic acid or sulphonate functional groups. In embodiments, the detersive polymer may not include sulfonic acid or sulfonate functional groups. In embodiments, the dishwasher compositions may be phosphorus free. The present disclosure is also directed to methods of making or manufacturing the dishwasher compositions.

In some aspects of the present disclosure, a dishwasher composition may include at least one strong chelant, at least one weak chelant, at least one surfactant, and at least one enzyme. The dishwasher composition may be a liquid or a gel having a pH of from 7.0 to 9.5, such as a pH of from 7.5 and 8.5, and the dishwasher composition may include less than 1.0 wt. % silicates based on the total weight of the dishwasher composition.

In one or more other aspects of the present disclosure, a method of washing articles may include forming a washing solution in a washing machine, the washing solution including water and a dishwasher composition. The dishwasher composition may include at least one strong chelant, at least one weak chelant, at least one surfactant, and at least one enzyme. The dishwasher composition may be a liquid or a gel having a pH of from 7.0 to 9.5, and the dishwasher composition may include less than 1.0 wt. % silicates based on the total weight of the dishwasher composition. The method may further include contacting at least one article with the washing solution during at least a portion of a wash cycle of a commercially-available dishwasher.

Additional features and advantages of the described embodiments will be set forth in the detailed description which follows, and in part will be readily apparent to those skilled in the art from that description or recognized by practicing the described embodiments, including the detailed description which follows and the claims.

DETAILED DESCRIPTION

The present disclosure is directed to dishwasher compositions that provide high-performance by providing competitive cleaning performance and also reducing the build-up of scale on dishes, such as glassware and plastic-ware for example. The dishwashing compositions of the present disclosure may include at least one strong chelant, at least one weak chelant, at least one surfactant, and at least one enzyme. The dishwasher compositions may be liquids or gels, may have a pH of from 7.0 to 9.5 and may have less than 1.0 wt. % silicates based on the total weight of the dishwasher composition. The dishwasher compositions may also include one or more detersive polymers, structuring agents, anti-spotting polymers, dispersants, other additives, or combinations thereof.

The dishwasher compositions of the present disclosure can provide comparable cleaning performance while reducing scale build-up, as evidenced by reduced spotting and filming, which can be caused by the problem of excessive hardness of water used in the wash cycle. In particular, the dishwasher compositions disclosed herein can provide a high standard of cleaning performance while maintaining the pH of the wash solution in a pH range of 7.0 to 9.5. Maintaining the pH of the wash solution in a pH range of 7.0 to 9.5 may result in a greater ratio of bicarbonate ions to carbonate ions in the wash solution compared to wash solutions having pH outside this pH range of 7.0 to 9.5. For example, in some embodiments, the dishwasher compositions of the present disclosure may maintain the wash solution at a pH of from 7.0 to 9.5, such as from 8.0 to 8.8, during the entire wash cycle, when conducted under the soil conditions described in ASTM D3556-14 using water having hardness of 325 mg/L at 54° C. and a wash cycle of 1 hour. Maintaining the wash solution at a pH of from 7.0 to 9.5, or from 8.0 to 8.8, may therefore result in a greater ratio of bicarbonate ions to carbonate ions compared to a pH outside the range of 7.0 to 9.5, or 8.0 to 8.8.

The dishwasher compositions disclosed herein do not contain intentionally added constituents, such as bicarbonates, carbonates, silicates, or other compounds, that interact negatively with hardness in the wash water to form scale through direct interaction with hardness ions or a through the common ion effect in combination with the heat of the washing process. For example, it has been found that commercially-available dishwasher liquid/gel products that contain intentionally-added bicarbonates and have a pH in a range of from 7.0 to 9.5 produce more precipitates that include insoluble, scale-forming carbonate ions due to the common ion effect and heat of the dishwasher wash solution, as compared to the dishwasher compositions of the present disclosure, which do not include intentionally added bicarbonates. The constituents in the dishwasher composition that do interact with calcium (Ca) and magnesium (Mg) ions may have high Ca and Mg tolerance to prevent precipitation of visible scaling crystals or solids (e.g., crystals or solids having dimensions greater than or equal to 500 nanometers) onto the surfaces of glassware or plastic-ware when used at concentrations and under the physical conditions of temperature and time in the dishwasher. Additionally, the dishwasher compositions of the present disclosure have a pH that is near neutral, which provides for greater safety for transportation and household use. The dishwasher compositions are not corrosive products, and have lesser skin irritancy potential compared to the commercially available liquid/gel dishwasher products having pH of greater than 9.5.

As used herein, the term "hard water" and "very hard water" refers to water having dissolved multivalent cation salts greater than 120 milligrams per liter (mg/L) (i.e., 120 parts per million (ppm) where 1 mg/L=1 ppm) and greater than 180 mg/L (i.e., 180 ppm), respectively (i.e. consistent with the US Geological Survey). Typically, the dominant cations in hard water are calcium and magnesium, and the dominant anions in hard water are bicarbonates, carbonates, chlorides and sulfates. Dishwasher formulation tests are typically conducted in very hard water at 300 mg/L (i.e., 300 ppm) hardness, as calcium carbonate equivalent, using a 2:1 calcium:magnesium molar ratio, as described in test method ASTM D3556-14. The water for such tests can be prepared with either chloride salts of calcium and magnesium added into purified water as described in ASTM D3556-14 or optionally with the further addition of bicarbonate anions as described in the IKW-Part B method (i.e. Recommendations for the Quality Assessment of the Cleaning Performance of Dishwasher Detergents, Part B, German Cosmetic, Toiletry, Perfumery and Detergent Association (2015)).

As used herein, the term "spotting" refers to trace deposits of precipitated solids remaining on the surface of an article after evaporation of all the water from the surface of the article. The precipitated solids may include re-deposited soil proteins, mineral salts such as salts or calcium or magnesium for example, or other constituents from the water that precipitate as the water evaporates. "Spotting" may manifest as discrete spots of precipitated solids deposited on the surfaces of the article (e.g., dishware, such as glassware, plastic-ware, etc.).

As used herein, the term "filming" may refer to the appearance of a more uniform deposition of precipitated solids over the surfaces of the article.

The dishwasher compositions of the present disclosure may be operable to maintain low concentrations of free Ca ions in the main wash solution and may provide for Ca control without forming visible precipitates on articles, to maintain costs, and to provide formulation flexibility. The dishwasher compositions may include a strong chelant, a weak chelant, at least one surfactant, and at least one enzyme.

As previously discussed, the dishwasher compositions may include a strong chelant and a weak chelant. Strong chelants have a strong affinity for metal ions and facilitate sequestration of metal ions, such as Ca and Mg ions, present in the wash solution and in soils present on the articles being washed. Additionally, the strong chelants effectively chelate metal ions associated with polyphenolic food stains, thus providing stain removal functionality to the dishwasher compositions. For example, the calcium salt component of a tea stain can be extracted from the stain, and ferric ions in the wash water, which can fix polyphenol stains to substrates, are effectively chelated. Strong chelants have high stability constant logarithms for both calcium and heavier metal ions (e.g., pK(Ca) greater than 5, where pK(Ca) is the stability constant logarithm for calcium) at the relevant wash pH conditions. The stability constant logarithm, pK(M) is a measure of the strength of the complex between the metal ion (M) and the chelant at the relevant wash pH conditions. Chelation with the strong metal ion chelant provides water soluble chelation. In embodiments, the strong chelant may include L-glutamic acid N,N-diacetic acid (GLDA) or its tetrasodium salt. Other strong chelants that may be incorporated into the dishwasher composition may include, but are not limited to, methylglycine diacetic acid (MGDA), ethylene diamine tetraacetic acid (EDTA), iminodisuccinic acid (IDS), other strong chelants, or metal ion salts thereof, or combinations of these.

In some embodiments, the dishwasher composition may include from 1 wt. % to 30 wt. % strong chelant (solid basis) based on the total weight of the dishwasher composition. For example, in some embodiments, the dishwasher composition may include from 1 wt. % to 20 wt. %, from 1 wt. % to 15 wt. %, from 1 wt. % to 10 wt. %, from 3 wt. % to 30 wt. %, from 3 wt. % to 20 wt. %, from 3 wt. % to 15 wt. %, or from 3 wt. % to 10 wt. % strong chelant (solid basis) based on the total weight of the dishwasher composition. In embodiments, the dishwasher composition may include from 1 weight percent (wt. %) to 30 wt. % GLDA (solid basis) based on the total weight of the dishwasher composition. As used in relation to the weight percent of strong chelants and weak chelants, the term "solid basis" refers to the solid content of chelant in the commercial raw material, which may be a solution of the chelant in a solvent such as water. The solid basis of chelant refers to the solid content of the chelant after the water and/or other solvents of the commercial raw material are removed in a laboratory test by evaporative drying. GLDA and other strong chelants are often sold as an aqueous solution of the strong chelant. For example, in some embodiments, GLDA may be in the form of an aqueous GLDA solution comprising 47 wt. % GLDA in water. In some embodiments, the dishwasher composition may include from 6 wt. % to 30 wt. % aqueous GLDA solution (i.e., weight percent of GLDA on a liquid basis, received as a 47% solution) based on the total weight of the dishwasher composition.

As previously discussed, the hardness control composition of the dishwasher composition may also include a weak chelant. In some embodiments, the weak chelant may include sodium citrate, sodium citrate dihydrate, or combinations thereof. In some embodiments, the weak chelant may be a citrate formed in situ during manufacturing of the dishwasher composition through the reaction of citric acid and sodium hydroxide. Since the commercial chelant GLDA is typically alkaline, when sodium citrate is used as the weak chelant instead of forming the citrate in situ using citric acid and sodium hydroxide, a small amount of citric acid may be included to adjust the pH of the dishwasher composition into the pH range of from 7.0 to 9.5. In some embodiments, the dishwasher composition may include sodium citrate as the weak chelant and may include a small amount of citric acid as a pH control agent to adjust the pH of the dishwasher composition to within the desired final pH range of from 7.0 to 9.5. In some embodiments, the dishwasher composition may have an amount of citric acid sufficient to adjust the pH of the dishwasher composition into the range of from 7.0 to 9.5. In some embodiments, the dishwasher composition may have an amount of citric acid sufficient to adjust the pH of the dishwasher composition into the range of from 7.5 to 8.5. The dishwasher composition may also include other weak chelants, such as, but not limited to, ethylenediamine-N,N-disuccinic acid (EDDS), gluconic acid, malic acid, metal ion salts thereof, or combinations of these weak chelants.

In some embodiments, the dishwasher compositions may include from 3 wt. % to 20 wt. % weak chelant (solid basis) based on the total weight of the dishwasher composition. For example, in some embodiments, the dishwasher composition may include from 3 wt. % to 18 wt. %, from 3 wt. % to 15 wt. %, from 3 wt. % to 10 wt. %, from 4 wt. % to 20 wt. %, from 4 wt. % to 18 wt. %, from 4 wt. % to 15 wt. %, or from 4 wt. % to 10 wt. % weak chelant (solid basis) based on the total weight of the dishwasher composition. In some embodiments, the dishwasher composition may include from 3 wt. % to 20 wt. % citrate (solid basis) based on the total weight of the dishwasher composition. Citrates can be added as solids or liquid solutions, or be made in situ from citric acid solid or citric acid solutions, with a neutralizing base such as sodium hydroxide. Citrates and other weak chelants, such as EDDS or gluconic acid, or their neutralized salts, for example, can be added as solids or as aqueous solutions of the weak chelant.

As previously discussed, the dishwasher compositions may include one or more detersive polymers, which may be a copolymer or terpolymer, which is a polymerized reaction product of one or more monomer units. In embodiments, the monomer units may include sulfonic acid and/or sulfonate containing monomer units and carboxylate containing monomer units, for example. The detersive polymer may be a copolymer, terpolymer, or tetrapolymer having 2, 3 or 4 different types of monomer units, respectively, which may contain one or more monomer with a sulfonic acid and/or sulfonate functional group, one or more monomers with carboxylic acid and/or carboxylate functional groups, one or more other monomers with varying degrees of nonionic character, or combinations of these. In embodiments, the detersive polymer may be a copolymer or terpolymer of sulfonate and carboxylate containing monomers, which is a polymerized reaction product of one or more monomers with at least one sulfonate end group, such as 2-acrylamido-2-methyl-propane sulfonate, with one or more different monomers with carboxylate end groups.

Detersive polymers including the sulfonated monomers may have a greater calcium tolerance compared to other polymers that do not include sulfonated monomers. Calcium tolerance may be defined as the maximum concentration of a polymer that can be achieved at a specific $Ca^{2+}$ ion solution strength, pH and temperature, without resulting in precipitation of solids. Detersive polymers having the sulfonated monomers may tolerate the presence of calcium and magnesium ions without undergoing reactions that produce precipitates.

The detersive polymer(s) may function as a calcium carbonate crystal growth inhibitor. The detersive polymer(s) may have superior calcium tolerance due to the sulfonic acid monomer inclusion and a relatively high capacity to lower free Ca ions in high hardness water. As previously discussed herein, calcium tolerance may be the maximum concentration of a polymer that can be achieved at a specific $Ca^{2+}$ ion solution strength, pH, and temperature without resulting in precipitation of solids (e.g., precipitation of Ca-polymer salts). The calcium tolerance of the detersive polymer may be influenced by the chemistry of the detersive polymer as well as the molecular weight of the detersive polymer. In some embodiments, the detersive polymer that includes the sulfonic acid monomer units may have a calcium tolerance that is greater than a calcium tolerance of a polymer that does not have the sulfonic acid monomer units, at a specific Ca2+ concentration, pH, and temperature, and is, thus, less likely to form precipitates and scale during the wash cycle. The detersive polymer as described above may also be a general food soil dispersant and may be operable to disperse general food soil.

In some embodiments, the sulfonic acid and/or sulfonate monomers in the detersive polymer may include one or more than one of 2-acrylamido-2-methyl-1-propanesulfonic acid, 4-sulfophenol methallyl ether, 3-allyloxy-2-hydroxy-1-propane sulfonic acid, 2-methacrylamido-2-methyl-1-propanesulphonic acid, 3-methacrylamido-2-hydroxy-propanesulphonic acid, allylsulphonic acid, methallylsulphonic acid, allyloxybenzenesulphonic acid, methallyloxybenzenesulphonic acid, 2-hydroxy-3-(2-propenyloxy)propanesulphonic acid, 2-methyl-2-propene-1-sulphonic acid, styrene sulphonic acid, vinylsulphonic acid, 3-sulphopropyl acrylate, 3-sulphopropyl methacrylate, sulphomethylacrylamide, sulphomethylinethacrylamide, 2-acrylamido-2-methyl-propane sulfonate, and water soluble salts thereof. In embodiments, at least one detersive polymer may include at least one sulfonic acid or sulfonate monomer selected from the group consisting of 2-acrylamido-2-methyl-1-propanesulfonic acid, 4-sulfophenol methallyl ether, 3-allyloxy-2-hydroxy-1-propane sulfonic acid, 2-methacrylamido-2-methyl-1-propanesulphonic acid, 3-methacrylamido-2-hydroxy-propanesulphonic acid, allylsulphonic acid, methallylsulphonic acid, allyloxybenzenesulphonic acid, methallyloxybenzenesulphonic acid, 2-hydroxy-3-(2-propenyloxy)propanesulphonic acid, 2-methyl-2-propene-1-sulphonic acid, styrene sulphonic acid, vinylsulphonic acid, 3-sulphopropyl acrylate, 3-sulphopropyl methacrylate, sulphomethylacrylamide, sulphomethylinethacrylamide, 2-acrylamido-2-methyl-propane sulfonate, and water soluble salts thereof. In embodiments, the sulfonic acid/sulfonate monomer may include 2-acrylamido-2-methyl-1-propanesulfonic acid. In embodiments, the sulfonic acid/sulfonate monomer may include 2-acrylamido-2-methyl-propane sulfonate.

The detersive polymers may include one or more of carboxylic acid monomer units (e.g. acrylic acid, maleic acid, methacrylic acid, itaconic acid, t-butyl acrylamide, aspartic acid), or other supplemental monomer units with more nonionic character, or combinations of supplemental monomer units, with or without monomers having sulfonic acid or sulfonate functional group. The supplemental monomers may have from 2 to 10 carbon atoms and may be saturated or unsaturated. For example, in some embodiments, the supplemental monomer may include a monoethylenically unsaturated C3-C6 carboxylic acid (e.g., methacrylic acid) or dicarboxylic acid (e.g., maleic acid). Other examples of supplemental monomers are disclosed in U.S. Pat. Nos. 6,395,185 and 5,547,612, which are incorporated herein by reference in their entirety. In some embodiments, the detersive polymers may include acrylic acid monomers, itaconic acid monomers, sulfonic acid, sulfonated styrene monomers, other carboxylate containing monomers, or combinations of these. The detersive polymers may be end-capped with a phosphono end group or other functional group.

In embodiments, the detersive polymer may include from 10 wt. % to 50 wt. % sulfonic acid or sulfonate containing monomer units based on the total weight of the detersive polymer. For example, in some embodiments, the detersive polymer may include from 10 wt. % to 45 wt. %, from 10 wt. % to 40 wt. %, from 15 wt. % to 50 wt. %, from 15 wt. % to 45 wt. %, from 15 wt. % to 40 wt. %, or from 20 wt. % to 50 wt. % sulfonic acid or sulfonate containing monomer units based on the total weight of the detersive polymer. In some embodiments, the detersive polymer consists of from 10 wt. % to 50 wt. % sulfonic acid and sulfonate containing monomer units and the balance carboxylic acid monomer units. The detersive polymer may have a weight average molecular weight (MWw) of less than or equal to 20,000 g/mol. In some embodiments, the detersive polymer may have a MWw of from 3,000 g/mol to 20,000 g/mol, or from 4,000 g/mol to 20,000 g/mol.

In embodiments, the dishwasher composition may include from 0.1 wt. % to 10 wt. % detersive polymers (dry basis) based on the total weight of the dishwasher composition. For example, in embodiments, the dishwasher composition may include from 0.1 wt. % to 6 wt. %, from 0.1 wt. % to 5 wt. %, from 0.1 wt. % to 4 wt. %, from 0.5 wt. % to 10 wt. %, from 0.5 wt. % to 6 wt. %, from 0.5 wt. % to 5 wt. %, from 0.5 wt. % to 4 wt. %, from 1 wt. % to 10 wt. %, from 1 wt. % to 6 wt. %, or from 1 wt. % to 5 wt. % detersive polymers (dry basis) based on the total weight of the dishwasher composition. As used in relation to the weight percent of detersive polymer, the term "solid basis" refers to the solid content of the detersive polymer in the commercial raw material, which may be a solution of the detersive polymer in a solvent such as water. The solid basis of detersive polymer refers to the solid content of the detersive polymer after the water and/or other solvents of the commercial raw material are removed in a laboratory test by evaporative drying. The detersive polymer is often sold as a detersive polymer solution, such as an aqueous detersive polymer solution. For example, ACUSOL™ 588 liquid marketed by Dow Chemical is a solution comprising 36-38 wt. % of the detersive polymer on a solids basis. In these embodiments, the dishwasher composition may include from 0.25 wt. % to 15.0 wt. % aqueous detersive polymer solution (i.e., weight percent of detersive polymer on a liquid basis) based on the total weight of the dishwasher composition. Other commercial examples of copolymers and terpolymers that may be used in the present invention include, but are not limited to, those manufactured by Dow Chemical, BASF, Lubrizol, Itaconix, Alco Chemical, Arkema, and others.

The dishwasher compositions may further include a structuring constituent that may be operable to modify the rheological behavior or properties of the dishwasher compositions. In embodiments, the structuring constituent may be operable to provide pseudoplastic behavior to the dishwasher composition so that retention of the dishwasher composition in the dispenser cup of the dishwasher is sufficient to reduce and/or minimize leakage of the dishwasher composition out of the dispenser cup during prewash stages of the wash cycle. In some embodiments, the structuring constituent is xanthan gum. Other structuring constituents, such as guar gum, cellulosic thickeners such as but not limited to hydroxyethyl and hydroxymethyl cellulose, or other natural gums may also be incorporated into the dishwasher compositions. The structuring constituent may also include cross-linked polyacrylate structurants or other conventional structuring constituents. Combinations of structuring constituents may also be incorporated.

The structuring constituent may provide a pseudoplastic characteristic to the dishwasher composition, meaning that the structuring constituent may enable the dishwasher composition to exhibit a high apparent viscosity under low shear rate conditions and a low apparent viscosity under high shear rate conditions. This pseudoplastic behavior provided by the structuring constituent may enable ease of bottle dispensing while maintaining good disperser cup retention in the dishwasher prior to the dispenser cup door opening. In some embodiments, the dishwasher compositions disclosed herein may have a low shear rate viscosity (e.g., viscosity at spindle 4 speed of 12 rpm) of 5000-15000 centipoise (cps), and a high shear rate viscosity (e.g., viscosity at spindle 4 speed of 60 rpm) of 1000-3000 cps, as measured on a Brookfield LVT viscometer at 25° C.

Many commercially-available dishwasher gels use cross-linked polyacrylate structurants (e.g., CARBOPOL® polymer products marketed by Lubrizol, POLYGEL rheology modifiers marketed by 3V Sigma, and others) to provide structure to the gels. Cross-linked polyacrylate structurants can be used in the present dishwasher composition but are not recommended. To adequately structure gels having the constituents of the dishwasher compositions described herein, the levels of cross-linked polyacrylate structurants must be raised above levels used in conventional alkaline dishwasher gels. It has been discovered that under conditions of hard water and short wash cycles, in which a greater amount of the hard water is used, calcium precipitates of the cross-linked polyacrylate structurant can be formed which are visible on both plastic-ware and in the dishwasher itself. The calcium precipitates of the cross-lined polyacrylate structurants are present as small flakes or larger beads after multiple washings at very high water hardness (i.e., greater than 180 mg/L).

In some embodiments, the dishwasher composition may include from 0.1 wt. % to 3 wt. %, or from 0.5 wt. % to 2.0 wt. % structuring constituent based on the total weight of the dishwasher composition. In some embodiments, the dishwasher composition may include from 0.1 wt. % to 3 wt. % xanthan gum based on the total weight of the dishwasher composition. In embodiments, the dishwasher composition may be substantially free of cross-linked polyacrylate structurants. As used in this disclosure, the term "substantially free" means less than 0.01 wt. % of a compound, molecule, atom, or other constituent in the dishwasher composition. For example, the dishwasher composition that is substantially free of cross-linked polyacrylate structurants includes less than 0.01 wt. % cross-linked polyacrylate structurants based on the total weight of the dishwasher composition.

As previously discussed, removal of tea and other bleachable stains may be further increased by increasing the amounts of the strong chelant GLDA in the dishwasher composition due to the high calcium and iron stability constants of the strong chelant GLDA. To the extent the formulation economics permit, GLDA can be increased. However, it has been discovered that very high levels of the strong chelant (e.g., concentrations greater than about 30 wt. % GLDA on a solids basis) cannot be tolerated due to structural considerations with xanthan gum cross-linking, which may result in a rigid gel product. The threshold concentration of strong chelant resulting in excessive cross-linking of the xanthan gum may be influenced by the total concentration of electrolytes (i.e., the total concentration of strong and weak chelants) in the dishwasher composition. In some embodiments, the dishwasher composition may have less than or equal to about 30 wt. %, less than or equal to 20 wt. %, or less than or equal to 15 wt. % strong chelant (solids basis) based on the total weight of the dishwasher composition in order to reduce or prevent cross-linking of the xanthan gum that results in a rigid get product.

The dishwasher composition may also include an enzyme composition comprising one or more than one enzyme. The enzymes in the enzyme compositions may be operable to remove proteins, starches, and other food soils from the articles being washed. The enzyme composition may be included in the dishwasher composition to improve the cleaning performance of the dishwasher composition and compensate for the lower pH of the dishwasher composition compared to commercially available dishwasher gels. Enzymes are globular proteins generally comprising a linear chain of amino acids that is folded in on itself to produce a three-dimensional structure. The enzymes catalyze reactions that result in the conversion of large organic molecules of proteins, carbohydrates, polysaccharides, triglycerides, starches, and other organic matter into smaller molecules, which may be more water-soluble or more easily removed by one or more of the other constituents of the dishwasher composition.

The enzyme compositions of the dishwasher composition may include one or more hydrolase enzymes. Hydrolase enzymes are enzymes that catalyze the hydrolysis of chemical bonds, which results in cleavage of larger molecules of food stains and soils into smaller molecules. Example hydrolase enzymes may include, but are not limited to protease, amylase, mannanase, lipase, pectinase, or other hydrolase enzymes. In some embodiments, the enzymes may be stable in the presence of the strong chelant (e.g., GLDA) in the aqueous state. For example, in some embodiments, the enzyme compositions may include protease, amylase, or combinations of these. In some embodiments, the enzyme compositions may include one or more enzymes that are highly stable in the presence of strong chelants. Additionally, when a plurality of enzymes are included, the different enzymes may be compatible in the same formulation (e.g., the protease does not alter the other enzyme protein structures, or itself).

In embodiments, the enzyme composition may include one or more enzyme stabilizing additives. In embodiments, the dishwasher composition may include enzyme compositions having enzymes that are less stable in the aqueous solution of strong chelant, and one or more enzyme stabilizing additives may be included in the dishwashing composition to increase the stability of the enzyme(s) in the dishwasher composition. Enzyme stabilizing additives may include, but are not limited to, commercially available stabilizers such as, but not limited to, sodium formate, sodium lactate, propylene glycol, tripeptide inhibitors, 4-formylphenylboronic acid, glycerol, polyols in general, other calcium ion sources, other boron sources, other stabilizer types, or combinations of these. In embodiments, the dishwasher composition may include one or more enzyme stabilizing additive comprising tripeptide inhibitors, 4-formylphenylboronic acid, or both. In some embodiments, the enzyme composition may include enzymes that are commercially available in a liquid form that includes the enzymes and one or more added enzyme stabilizer additives. In cases in which a calcium ion source is used as the enzyme stabilizing additive, the calcium introduced by the enzyme stabilizing additive to assist in stabilizing the enzymes in the enzyme composition is negligible compared to the calcium and magnesium ion concentrations introduced to the dishwasher wash solution in hard water conditions. In cases in which one or more enzymes are susceptible to attack by the strong chelant, the calcium ion level in the dishwasher composition can be increased and the strong chelant concentration can be reduced to mitigate this effect.

In some embodiments, the dishwasher composition may include from 0.1 wt. % to 6.0 wt. % total enzyme compositions based on the total weight of the dishwasher composition. The total enzyme compositions include all of the enzymes as well as the optional enzyme stabilizing additives. In some embodiments, the dishwasher composition may include from 0.1 wt. % to 5.0 wt. %, from 0.1 wt. % to 4.0 wt. %, from 0.5 wt. % to 6.0 wt. %, from 0.5 wt. % to 5.0 wt. %, from 0.5 wt. % to 4.0 wt. %, from 1.0 wt. % to 6.0 wt. %, or from 1.0 wt. % to 5.0 wt. % total enzyme compositions based on the total weight of the dishwasher composition. In embodiments, the dishwasher composition may include from 0.1 wt. % to 5.0 wt. %, from 0.1 wt. % to 4.0 wt. %, or from 0.1 wt. % to 3.0 wt. % hydrolase enzymes. In some embodiments, the dishwasher composition may include from 0.1 wt. % to 3.0 wt. % amylase-containing enzyme composition based on the total weight of the dishwasher composition. In some embodiments, the dishwasher composition may include from 0.1 wt. % to 3.0 wt. % protease-containing enzyme composition based on the total weight of the dishwasher composition.

In some embodiments, the dishwasher composition may further include an anti-spotting polymer, which may be operable to reduce protein spots and resulting films (due to poor drainage) on the articles being washed. Anti-spotting polymers are polymers that, when added to a detergent formulation, may result in reducing or eliminating spotting caused by re-deposition of proteins on the surfaces of the articles compared to the detergent formulation without the anti-spotting polymer. Not intending to be bound by any particular theory, it is believed that the anti-spotting polymers can reduce protein spots and filming by stabilizing and dispersing protein soils in the wash water so that they do not absorb onto the surfaces of dishware, such as glassware, plasticware, etc. Although the anti-spotting polymers may help reduce spotting and filming by preventing or reducing re-deposition of proteins onto the surfaces of the dishware, the anti-spotting polymers may have a little effect on deposition of mineral ion salts, such as salts of calcium and magnesium ions, on the surfaces of the dishware. Examples of the anti-spotting polymers include, but are not limited to, copolymers of diisobutylene and maleic acid, such as ACUSOL™ 460 dispersant marketed by Dow Chemical, for example. ACUSOL™ 460 dispersant is a solution comprising 25 wt. % anti-spotting polymer. In some embodiments, the dishwasher composition may include less than or equal to 2.0 wt. %, or less than or equal to 1 wt. % anti-spotting polymer on a solids basis based on the total weight of the dishwasher composition. For the anti-spotting polymer, the weight percent is determined using the total weight of the anti-spotting polymer composition, which includes the anti-spotting polymer and the diluent. In some embodiments, the dishwasher composition may include from 0.01 wt. % to 2.0 wt. %, or from 0.1 wt. % to 1.0 wt. % anti-spotting polymer composition based on the total weight of the dishwasher composition.

The dishwasher composition may include one or a plurality of surfactants. The surfactants may be operable to emulsify grease, remove triglycerides, and reduce water surface tension and/or oil-in-water interfacial tension. Surfactant selection and quantities may be determined by balancing the factors of water solubility, critical micelle concentration (CMC), hardness ion tolerance, foam, and soil removal performance. The surfactants may include one or more anionic surfactants and/or nonionic surfactants. In some embodiments, the surfactant may be a low foaming, nonionic surfactant, such as alcohol alkoxylates, block copolymers of ethylene oxide/propylene oxide, or combinations of these surfactants. Low foaming surfactants refer to surfactants that exhibit foam suppression or defoaming properties that operate to reduce the level of foaming in the dishwasher during the wash cycle. In some cases, the surfactant may be a very low foaming surfactant, which is defined as a surfactant for which the Ross Miles foam height test (i.e., test method ASTM D1173-07 (2015)) shows zero height of foam at a concentration of 0.5 wt. % surfactant in water at 60° C. In some embodiments, the dishwasher composition may include alcohol alkoxylates as the surfactant. The alcohol alkoxylates exhibit low cloud points (<24° C., 1% aqueous solution) in water, very low foaming behavior (e.g., Ross Miles foam height test result showing zero foam at 0.5% and 60 C), good soil removal and grease emulsification performance, low surface tension, low oil-in-water interfacial tension, low critical micelle concentration, and very good water sheeting action to minimize water spotting and aid in article drying in the dishwasher. In some embodiments, the dishwasher composition may include from 1 wt. % to 10 wt. %, or from 1 wt. % to 5 wt. % surfactant based on the total weight of the dishwasher composition.

Examples of other anionic or non-ionic surfactants that may be suitable for inclusion in the dishwasher composition may include, but are not limited to, sodium alkyl aryl sulfonate, sodium dodecylbenzene sulfonate (NaDBSA), the monoethanolamine salt of dodecylbenzene sulfonate, methyl ester sulfonates (MES) such as sodium alkyl methyl ester sulfonate and sodium fatty acid methyl ester sulfonate, sodium alkyl sulfate, sodium lauryl sulfate (SLS), sodium lauryl ether sulfate (SLES), sodium alkyl ether sulfate, alkyl ethoxylated sulfates, alkyl alkoxylated sulfates, alpha olefin sulfonates (AOS), alkyl dimethyl amine oxides (AO), alcohol ethoxylates, alcohol ethoxylated sulfates, other surfactants, and combinations of these surfactants. Suitable surfactants may also include alkyl benzene sulfonates having alkyl groups that may be linear or branched alkyl groups having from 10 carbon atoms to 16 carbon atoms. Generally, the foaming tendency of anionic surfactants under dishwasher conditions may substantially limit the tolerable amount of such anionic surfactants in the dishwasher composition.

The dishwasher composition may further include one or more detersive polymers. Each of the detersive polymers may be a polymerized reaction product of one or more different monomers such as but not limited to monomers derived from one or more of the following monomer acids forms or their neutralized formats: acrylic acid, maleic acid, methacrylic acid, itaconic acid, t-butyl acrylamide, aspartic acid, 2-acrylamido-2-methyl-propane sulfonic acid, sulfonated styrene, or other monomer units containing sulfonic acid, and combinations thereof. The detersive polymers may have a weight average molecular weight of less than or equal to 15,000 g/mol. In embodiments, one or more of the detersive polymers may have a phosphono end group on the molecule. In embodiments, the detersive polymer may include carboxymethyl inulin monomer units. In other words, the detersive polymer may be a polymerized reaction product of carboxymethyl inulin monomer units and one or more other monomer units, such as but not limited to acrylic acid, maleic acid, methacrylic acid, itaconic acid, t-butyl acrylamide, aspartic acid, 2-acrylamido-2-methyl-propane sulfonic acid, sulfonated styrene, or other monomer units containing sulfonic acid, and combinations thereof. The dishwasher composition may include from 0.1 wt. % to 10 wt. %, from 0.1 wt. % to 6 wt. %, from 0.1 wt. % to 5 wt.

%, from 0.1 wt. % to 4 wt. %, from 0.5 wt. % to 10 wt. %, from 0.5 wt. % to 6 wt. %, from 0.5 wt. % to 5 wt. %, from 0.5 wt. % to 4 wt. %, from 1 wt. % to 10 wt. %, from 1 wt. % to 6 wt. %, or from 1 wt. % to 5 wt. % detersive polymers on a solids basis based on the total weight of the dishwasher composition.

The dishwasher composition includes water to make up the balance of the dishwasher composition. The water may be municipal water, purified water, distilled water, filtered water, softened water, or other type of water. In some embodiments, the dishwasher composition may include water having a concentration of chlorine ($Cl_2$) of less than 0.05 milliliters per Liter of water (ml/L). In some embodiments, the water in the dishwasher composition may be dechlorinated water. Municipal water obtained from municipal treatment facilities may often be chlorinated with hypochlorite, or hypochlorite and ammonia to form chloramines, such as monochloramines. Prior to adding this municipal water in the preparation of the dishwashing compositions disclosed herein, the municipal water source may be treated (e.g., dechlorinated) to chemically reduce the free chlorine and chloramines by a redox reaction, using a reducing agent, such as sodium meta-bisulfate, to reduce the concentration of free chlorine and/or chloramines to less than 0.05 ml/L. Chlorine in the water source may act to destabilize enzymes, such as amylase enzymes, in the dishwasher composition. Thus, removal of free chlorine from the water used in the dishwasher composition may increase the stability and effectiveness of enzymes included in the dishwasher composition.

The dishwasher composition may optionally include one or more additives to modify the properties or characteristics of the dishwasher composition. Additives may include preservatives, germicides, fungicides, hydrotropes, optical brighteners, anti-oxidants, color speckles, solubilizing agents, carriers, phosphonates, other crystal growth inhibitors, one or more secondary polymers, fragrances, colorants, encapsulated bleach particles, pH adjusting agents, defoamers, etching inhibitors, corrosion inhibitors, and mixtures thereof.

In some embodiments, the dishwasher composition may include one or a plurality of preservative constituents operable to preserve the dishwasher composition against decomposition from bacteria, fungi, or other biologic agents. In some embodiments, preservation of the dishwasher composition may be accomplished by including a suitable preservative in the xanthan gum premix step. For example, in some embodiments, the dishwasher composition may include 2 parts per million by weight (ppmw) to 6 ppmw isothiazolinones (e.g., methylchloroisothiazolinone (MCI), methylisothiazolinone (MI), benzisothiazolinone (BI), or some combination of these) based on the total weight of the dishwasher composition, which may be added to the xanthan gum during the xanthan gum premix step of the manufacturing process. Depending upon the premix pH, the pH during manufacturing, and the final product pH, the isothiazolinone composition may be optimized for stability, with the MCI being more stable at pH 8 and under, while the BI being more stable over pH 8. However, for preserving the xanthan gum premix in isolation, the MCI/MI commercial blends are preferred as this step is always at a pH less than 8, and this blend provides wider microbiological efficacy (i.e. yeast, mold and bacteria) during this step of manufacturing. Other suitable preservatives may also be included in the dishwasher composition. Additionally or alternatively, in some embodiments, the dishwasher composition may include sodium benzoate, or other preservative, as the principal preservative working synergistically with the GLDA chelant, which acts as cellular membrane disruptor allowing the preservative to enter the cell. In some embodiments, the dishwasher composition may include from 0.1 wt. % to 1.0 wt. %, or from 0.3 wt. % to 0.6 wt. % sodium benzoate or other preservative constituent based on the total weight of the dishwasher composition. It has further been discovered that the dishwasher compositions that include the combination of the sodium benzoate as the primary preservative and the isothiazolinones added to the xanthan gum premix exhibit excellent preservative efficacy, as measured by standard test protocols (e.g., United States Pharmacopeia Chapter <51>, "Antimicrobial Effectiveness Testing).

In embodiments, the dishwasher composition may optionally include one or more phosphonate compounds. Phosphonate compounds and phosphonate combinations may include but are not limited to 1-hydroxyethylidene 1,1-diphosphonic acid, 2-phosphonobutane-1,2,4,-tricarboxylic acid, amino tris (methylene phosphonic acid), the metal salt forms of these phosphonated, or combinations of these. The phosphonate compounds may function as calcium crystal growth inhibitors, which may work synergistically with other constituents of the dishwasher composition, such as the detersive polymer previously described herein, to improve Ca ion control. The phosphonate compounds may be present in the dishwasher composition at concentrations up to the point of a total concentration of elemental phosphorous in the dishwasher composition of less than 0.5 wt. %. When employed, it is possible that formation of insoluble salts comprising Ca ions and the phosphonates may occur depending upon the polymer combinations and concentrations used and the water hardness and temperature. In some embodiments, the dishwasher composition may be substantially free of phosphorous. As previously discussed, the term "substantially free" means less than 0.01 wt. % of a compound, molecule, atom, or other constituent in the dishwasher composition. Thus, in some embodiments, the dishwasher composition that is substantially free of phosphorous may include less than 0.01 wt. % phosphorous.

In some embodiments, the dishwasher composition may also include one or more fragrance compounds or colorants. In some embodiments, the dishwasher composition may include encapsulated bleach particles, which may provide oxidation reaction performance to the dishwasher composition. The dishwasher composition may include other additives to enhance the aesthetic of the dishwasher composition.

The dishwasher compositions of the present disclosure may have a specific gravity greater than or equal to 1.03, such as greater than or equal to 1.05, or even greater than or equal to 1.07. The dishwasher compositions may have a specific gravity of less than or equal to 1.25, such as less than or equal to 1.18, or even less than or equal to 1.16. In some embodiments, the dishwasher compositions may have a specific gravity of from 1.03 to 1.20, from 1.05 to 1.18, or from 1.07 to 1.16.

The dishwasher composition may have a pH that is less than many commercially available dishwasher liquid/gel products, which can have alkaline pH of greater than 9.5 or even greater than 10. The dishwasher composition may have a pH of from 7.0 to 9.5, such as from 7.0 to 9.0, from 7.0 to 8.5, from 7.5 to 9.5, from 7.5 to 9.0, or from 7.5 to 8.5, in which the pH of the dishwasher composition is measured directly without dilution of the dishwasher composition to a specific concentration. The reduced pH of the dishwasher composition may result in the dishwasher compositions of the present disclosure providing greater safety for transportation and household use. The dishwasher compositions of the present disclosure having near-neutral pH may be less corrosive and have lesser skin irritancy potential compared to higher pH commercially-available liquid/gel dishwasher products.

The greater alkalinity (i.e., pH of greater than 9.5) of commercially-available liquid/gel dishwasher products contributes to the cleaning performance of the commercially-available liquid/gel dishwasher products. For example, the greater alkalinity of the commercially-available liquid/gel dishwasher products may cause swelling effects on starches by deprotonation of hydroxyl groups, the ionization of proteins causing intra-soil repulsion, the soil-substrate repulsion due to negative charges and the removal of tea or polyphenolic stains. In the absence of high alkalinity (i.e., pH greater than 9.5), the dishwasher compositions of the present disclosure include the combination of the strong chelant and the enzyme composition compatible with the strong chelant to improve the cleaning performance of the dishwasher compositions. As previously discussed, the enzyme composition may include one or more enzymes that are stable in the presence of the strong chelant. In other embodiments the enzyme composition may include less stable enzymes in combination with an enzyme stabilizer. The combination of the chelant and enzyme composition may provide the dishwasher compositions of the present disclosure with cleaning performance comparable to commercially-available dishwasher liquid/gel or solid products having greater alkalinity (e.g., pH greater than 9.5).

The combination of the specific constituents in the dishwasher composition may provide a cost effective treatment of Ca and Mg ions via the mechanisms of ion exchange to form soluble Ca and Mg salts while reducing visible scale formulation. The constituents of the dishwasher compositions of the present disclosure may be less likely to form visible solids (i.e. solids having an average particle size of greater than or equal to about 500 nm) that precipitate onto glassware or plastic-ware. The dishwasher compositions of the present disclosure have reduced concentrations of silicates, carbonates, and bicarbonates. Sodium silicates may cause in-situ formation of the film-forming magnesium silicate in the dishwasher, particularly under conditions of very hard (i.e., hardness greater than 180 mg/L) mixed-cation containing municipal water and high water consumption, such as water consumption greater than 15 liters per cycle or even greater than 20 liters per cycle. Bicarbonates can convert to carbonate ions via the heat of the dishwashing process, resulting in additional calcium carbonate scale. In some embodiments, the dishwasher composition may have less than or equal to 1.0 wt. %, less than or equal to 0.5 wt. %, less than or equal to 0.4 wt. %, less than or equal to 0.3 wt. %, less than or equal to 0.1 wt. %, less than or equal to 0.05 wt. %, or even less than or equal to 0.01 wt. % silicates, such as sodium silicate, based on the total weight of the dishwasher composition. In some embodiments, the dishwasher composition may have less than or equal to 5 wt. %, less than or equal to 1.0 wt. %, less than or equal to 0.5 wt. %, less than or equal to 0.1 wt. %, less than or equal to 0.05 wt. %, or even less than or equal to 0.01 wt. % carbonates and alkali metal salts of carbonates based on the total weight of the dishwasher composition. In some embodiments, the dishwasher composition may have less than or equal to 15 wt. %, less than or equal to 10 wt. %, less than or equal to 5 wt. %, less than or equal to 1 wt. %, less than or equal to 0.5 wt. %, less than or equal to 0.1 wt. %, less than or equal to 0.05 wt. %, or even less than or equal to 0.01 wt. % bicarbonates and alkali metal salts of bicarbonate based on the total weight of the dishwasher composition. In some embodiments, the total amount of silicates, carbonates, and bicarbonates in the dishwasher composition may be less than or equal to 15 wt. %, less than or equal to 10 wt. %, less than or equal to 5 wt. %, less than or equal to 1 wt. %, less than or equal to 0.5 wt. %, less than or equal to 0.1 wt. %, less than or equal to 0.05 wt. %, or even less than or equal to 0.01 wt. % based on the total weight of the dishwasher composition. In some embodiments, the dishwasher compositions may be substantially free of silicates, carbonates, and bicarbonates.

The dishwasher composition may also include reduced concentrations of sodium sulfates and sodium chlorides. In some embodiments, the dishwasher composition may have less than or equal to 15 wt. %, less than or equal to 10 wt. %, less than or equal to 5 wt. %, less than or equal to 1 wt. %, less than or equal to 0.5 wt. %, less than or equal to 0.1 wt. %, less than or equal to 0.05 wt. %, or even less than or equal to 0.01 wt. % sodium sulfates based on the total weight of the dishwasher composition. In some embodiments, the dishwasher composition may have less than or equal to 15 wt. %, less than or equal to 10 wt. %, less than or equal to 5 wt. %, less than or equal to 1 wt. %, less than or equal to 0.5 wt. %, less than or equal to 0.1 wt. %, less than or equal to 0.05 wt. %, or even less than or equal to 0.01 wt. % sodium chlorides based on the total weight of the dishwasher composition.

In some embodiments, the dishwasher composition may include from 1 wt. % to 30 wt. % strong chelant on a solids basis, from 3 wt. % to 20 wt. % weak chelant on a solids basis, from 0.1 wt. % to 6.0 wt. % enzymes, and from 1.0 wt. % to 10.0 wt. % surfactant, and the balance water, and the dishwasher composition has a pH of from 7.0 to 9.5 and may have a specific gravity of from 1.03 to 1.20. In some embodiments, the dishwasher composition may further include from 0.1 wt. % to 3.0 wt. % structuring constituent, from 0.1 wt. % to 10.0 wt. % detersive polymer on a solids basis, from 0.1 wt. % to 2.0 wt. % anti-spotting polymer, from 0.02 wt. % to 0.05 wt. % preservative, or combinations of these.

In some embodiments, the ranges of the constituents of the dishwasher compositions and the commercially available materials for certain of the constituents are described below in Table 1. The weight percentages in Table 1 are on a solution basis for each of the components (i.e., the weight percentages in Table 1 for the strong chelant, weak chelant, and detersive polymer are on a solution basis and not on a solids basis).

TABLE 1

Composition and Properties of Some Embodiments of the Dishwasher Compositions of the Present Disclosure

| Dishwasher Composition Constituent | Weight Percent |
|---|---|
| Water (e.g., municipal, softened, or purified) | to 100 |
| Surfactant (e.g., alcohol alkoxylate such as Plurafac SLF180 - BASF) | 1.0-10.0 |
| Strong Chelant Solution (e.g., Dissolvine GL-47 S by Nouryon tetrasodium glutamate diacetate 47 wt. % solution) | 1.0-30.0 |
| Weak Chelant (e.g., sodium citrate (anhydrous) solids - added from sodium citrate sources, citric acid and sodium hydroxide, or any combinations thereof) | 3.0-20.0 |
| Detersive Polymer (e.g., ACUSOL ™ 588 liquid by Dow Chemical - sulfonated carboxylated polymer 36-38 wt. % solution) | 0.25-15.0 |
| Anti-Spotting Polymer (e.g., ACUSOL ™ 460 liquid by Dow Chemical, 25 wt. % solution) | 0.1-2.0 |

TABLE 1-continued

| Composition and Properties of Some Embodiments of the Dishwasher Compositions of the Present Disclosure | |
|---|---|
| Dishwasher Composition Constituent | Weight Percent |
| Preservative (e.g., sodium benzoate) | 0.3-0.6 |
| Structural Constituent - Xanthan Gum | 0.5-2.0 |
| Preservative (e.g., KATHON ™ CG/ICP preservative (1.5% active MCI/MI total) - Dow Chemical) | 0.02-0.05 |
| Protease Enzyme (e.g., Blaze Pro 100, protease liquid enzyme by Novozymes) | 0.4-3.0 |
| Amylase Enzyme (e.g., Achieve Alpha 100 L, amylase liquid enzyme by Novozymes) | 0.1-3.0 |
| Fragrance | 0.0-2.0 |
| Properties | |
| pH* | 7.0-9.5 |
| Specific Gravity (S.G.) | 1.03-1.20 |

*direct measurement of dishwasher composition without dilution of the dishwasher composition A method of making the dishwasher composition will now be described. In a first step, the structuring constituent (e.g., xanthan gum) may be premixed with a first amount of de-chlorinated water and, optionally, a preservative (e.g., MCI, MI, BI or some combination) to produce a first mixture. This is typically performed using a powder eductor to disperse the structuring constituent in the water, followed by batch mixing in a mixer suitably designed for high viscosity fluids. As previously discussed, the water may be municipal water, softened, or highly purified water. Regardless of the water source, the chlorine content should be reduced to <0.05 mg/L through the introduction of a suitable reducing agent, such as sodium metabisulfite, to improve the stability of the amylase or other enzymes in the final dishwasher compositions.

In a second step, a second mixture is prepared by adding the strong chelant, weak chelant and polymers to a second amount of de-chlorinated water. In some embodiments, the weak chelant comprising a citrate may be made in situ by adding citric acid and sodium hydroxide. In some embodiments, the second step may include adding sodium hydroxide to the water first before adding the citric acid. Adding the sodium hydroxide first may provide added hygiene benefits in a continuous batching operation by greatly increasing the pH with the sodium hydroxide to a highly alkaline state before bringing the pH back down with the citric acid. This would then be followed by addition of the strong chelant. Before addition of surfactant, polymers, and other ingredients, the pH may be adjusted with citric acid and/or sodium hydroxide, to within a pH range of from 7.0 to 9.5. Prior to addition of the enzymes, the pH of the second mixture may again be adjusted to within a range of from 7.0 to 9.5, such as to within a range of from 7.5 to 8.5. The batch temperature may be maintained at a temperature less than 25° C. prior to the enzyme additions. After each addition, the second mixture may be thoroughly mixed to produce a homogenous mixture.

Once the second mixture is prepared, the first mixture that includes the structuring constituent may be added to the second mixture to produce the dishwasher composition. The dishwasher composition may then be packaged in conventional packaging. The dishwasher composition may also be prepared with different equipment and different order of addition, provided the process ensures that the resulting physical and chemical characteristics and stability of the dishwasher composition and its constituents are achieved.

The present disclosure includes methods of using the dishwasher compositions. In some embodiments, a method of cleaning one or more articles includes contacting the one or more articles with a washing solution comprising water and a dishwasher composition. The dishwasher composition may have any of the features and/or constituents previously described in this disclosure. The method may further include circulating the washing solution into contact with the articles for a period of time, and rinsing the washing solution from the surfaces of the articles.

In some embodiments, a method of washing articles, such as dishes, may include forming a washing solution in a washing machine. The washing solution may include water and the dishwasher composition disclosed herein. The dishwasher composition includes at least one strong chelant, at least one weak chelant, at least one surfactant, and at least one enzyme. The dishwasher composition may be a liquid or a gel and has a pH of from 7.0 to 9.5. The method may further include contacting at least one article with the washing solution during at least a portion of a wash cycle of a commercially-available dishwasher.

In some embodiments, the articles may include dishes, such as one or more of glassware, plastic-ware, metal dishes and utensils, ceramic articles, or other types of dishes. In some embodiments, the wash cycle may have a duration of less than or equal to 3 hours, less than or equal to 2.5 hours, less than or equal to 120 minutes, less than or equal to 90 minutes, less than or equal to 80 minutes, less than or equal to 70 minutes, or even less than or equal to 60 minutes. In embodiments, the wash cycle may have a duration of from 30 minutes to 3 hours.

The dishwasher compositions of the present application can be used with water prepared as indicated by these methods, or water having similar hardness properties. The water used in the dishwashing cycle may have a hardness of greater than or equal to 100 mg/L. The dishwasher compositions of the present disclosure may apply, additionally, to water hardness up to 325 mg/L (i.e., 325 ppm), such as hardness from 100 mg/L to 325 mg/L. The dishwasher compositions of the present disclosure may also apply to other hard water or very hard water sources, including municipal water, treated water, well water, fresh water, or other water having high or very high water hardness (150 mg/L or 180 mg/L, respectively), which may have properties similar to the waters prepared according to the test methods discussed previously. In some embodiments, the water may have a hardness greater than or equal to 100 mg/L, greater than or equal to 150 mg/L, or even greater than or equal to 180 mg/L. In some embodiments, the water may have a hardness of from 100 mg/L to 325 mg/L, from 150 mg/L to 325 mg/L, or even from 180 mg/L to 325 mg/L.

The dishwasher composition of the present disclosure, which may be a "liquid" or "gel" product, can achieve materially better or superior filming scores (i.e. very low visible film) under ASTM D3556-14 conditions of 5 consecutive washes, when tested with very hard water comprised of calcium and magnesium chlorides or calcium and magnesium bicarbonates (as is typically found in municipalities) at 181 mg/L (181 ppm) or greater, including hardness up to 325 mg/L (i.e., 325 ppm), compared to other commercially available dish gels. The dishwasher compositions of the present disclosure also provide comparable or improved spotting/filming performance on glassware, under test conditions above, compared to many other commercially-available dishwasher products, including powders and unit dose powders or multi-chamber pods or packs. The cleaning performance of the dishwasher compositions have been found to be comparable to leading National brand dishwashing gel products. Thus, the dishwasher compositions disclosed herein provide superior filming and spotting performance without reducing the cleaning performance of the composition.

EXAMPLES

The following examples illustrate one or more additional features of the present disclosure described previously. It should be understood that these examples are not intended to limit the scope of the disclosure or the appended claims in any manner.

Example 1: Dishwasher Composition of the Present Disclosure

In Example 1, a dishwasher composition according to the present disclosure was prepared. The formulation for the dishwasher composition of Example 1 is provided below in Table 2. In the first step, the xanthan gum structuring agent was mixed with a first quantity of water and the KATHON™ CG preservative obtained from DOW Chemical Company to produce a first mixture. A second mixture was prepared by adding the sodium hydroxide and citric acid to a second quantity of water to prepare the weak chelant. The strong chelant, detersive polymer, anti-spotting polymer, surfactant, fragrance, and secondary preservative were then added to the second mixture. The pH was adjusted into the range of 7.5 to 8.5, and the enzymes were added. After mixing thoroughly, the first mixture that included the xanthan gum structuring agent was added to the second mixture to produce the dishwasher composition of Example 1. The percent solids and specific gravity of the dishwasher composition of Example 1 is also provided below in Table 2. The percent solids was determined by thermogravimetric analysis at 105° C., and the specific gravity was determined using a pycnometer. The weight percentages in Table 2 below are provided on a total solution basis (i.e. the commercial chemical as received including the active constituents as well as solvents, diluents, additives, etc.)

TABLE 2

Formulation of the Dishwasher Composition of Example 1
Dishwasher Composition of Example 1

| Constituent of Dishwasher Composition | wt. %* |
|---|---|
| Preservative (KATHON ™ CG preservative from DOW) | 0.04 |
| Structuring Agent (xanthan gum (TN grade) from Jungbunzlauer, Inc.) | 0.8 |
| 50% Sodium hydroxide (in situ formation of weak chelant) | 3.886 |
| Citric Acid Anhydrous (in situ formation of weak chelant) | 4.19 |
| Strong Chelant (GLDA - DISSOLVINE ® GL-47-S from Nouryon) | 14.0 |
| Surfactant (PLURAFAC ® SLF180 surfactant from BASF) | 2.5 |
| Anti-Spotting Polymer (ACUSOL ™ 460N Liquid from Dow) | 0.2 |
| Detersive Polymer (ACUSOL ™ 588N acrylic/sulphonic acid copolymer liquid from DOW) | 0.75 |
| Secondary Preservative (sodium benzoate) | 0.4 |
| Fragrance | 0.15 |
| Protease Enzyme (Blaze Pro 100 protease enzyme from Novozymes) | 0.78 |
| Amylase Enzymes (Achieve Alpha 100 L amylase from Novozymes) | 0.30 |
| Purified Water | Balance to 100 |
| Specific Gravity (pycnometer) | 1.095 |
| Percent Solids by weight (thermogravimetric analysis at 105° C.) | 21.1 |

*Weight percentages are on a total solution basis (i.e., weight of active material and solvent/diluent divided by the total weight of the dishwasher composition).

Comparative Examples 2-5: Commercially Available Dishwasher Products

For Comparative Examples 2-5, leading National brand commercially-available dishwasher gels were obtained. Each of the commercially-available dishwasher gels of Comparative Examples 2-5 included as an intentional additive at least one of sodium silicate, sodium bicarbonate, and sodium carbonate. The commercially-available dishwasher gels of Comparative Examples 2-5 along with the specific gravity and percent solids, as determined by thermogravimetric analysis at 105° C., are provided below in Table 3.

TABLE 3

Properties for the Commercially-Available Dishwasher Compositions of Comparative Examples 2-5

| ID | Commercially-Available Dishwasher Composition | Specific Gravity | % Solids (thermogravimetric analysis at 105° C.) |
|---|---|---|---|
| Comp. Ex. 2 | CASCADE ® COMPLETE ™ Dishwasher Gel - DAWN ® 8x Power (Code: 82621731041904) | 1.274 | 36.3 |
| Comp. Ex. 3 | CASCADE ® Dishwasher Gel Gel - DAWN ® 6x Power (Code: 82491731040956) | 1.261 | 39.9 |
| Comp. Ex. 4 | CASCADE ® Dishwasher Gel - CLOROX ® 6x Power (Code: 82201731041519) | 1.254 | 34.4 |
| Comp. Ex. 5 | FINISH ® Dishwasher Gel - Advanced Formula (Code: 518220 (20:51) M01) | 1.183 | 29.6 |

Example 6: Comparison of the Dishwasher Composition of Example 1 to the Commercially Available Dishwasher Gels of Comparative Examples 2-5

In Example 6, the spotting and filming performance of the dishwasher composition of Example 1 was evaluated against the performance of the commercially available dishwasher gels of Comparative Examples 2-5. For use in preparing washing solutions of Example 6, hard water samples having a hardness of 200 mg/L (200 ppm) and 325 mg/L (325 ppm) were prepared according to IKW—Part B (previously referenced herein) using stock solutions of sodium bicarbonate, calcium chloride, and magnesium chloride. The spotting and filming performance for each of the dishwasher composition of Example 1 and the commercially-available dishwasher gels of Comparative Examples 2-5 were evaluated according to test method ASTM D3556-14 using a Whirlpool Model WDF760SADM3 dishwashing machine. The wash cycle for each test was 1 hour and the heat/dry option was not selected. For each wash, a sample size of 40 ml of each composition was added to the main wash dispenser of the washing machine used for the test method. The volume was determined by weight measurement of the sample using the measured specific gravity for each composition. The measured specific gravities for the dishwasher compositions of Example 1 and the commercially-available dishwasher gels of Comparative Examples 2-5 are provided in Tables 2 and 3, respectively.

The spotting and filming performance for the dishwasher composition of Example 1 and the commercially available dishwasher gel of Comparative Example 2 were evaluated for a wash cycle having a duration of 1 hour and a water hardness of 200 mg/L (200 ppm), and the results are provided below in Table 4. The spotting and filming performance for the dishwasher composition of Example 1 and the commercially available dishwasher gels of Comparative Examples 2-5 were evaluated for a similar wash cycle having a duration of 1 hour and a water hardness of 325 mg/L (325 ppm), and the results are also provided below in Table 4. The spotting and filming evaluation was conducted using tall glasses. In accordance with ASTM D3556-14, a single set of glasses were subjected to five consecutive washes with each composition. The final appraisal of the spotting and filming performance for each composition was determined after the fifth consecutive wash. The spotting score and filming score were evaluated for each glass in the set, and the average spotting score and filming score for each composition taken across all the glasses in the set were calculated. Table 4 reports the average spotting score and average filming score for each composition.

TABLE 4

Spotting and Filming Performance for the Compositions of Example 1 and Comparative Examples 2-5

| | 1 Hour Wash with 200 ppm Water Hardness | | 1 Hour Wash with 325 ppm Water Hardness | |
|---|---|---|---|---|
| Sample | Ave Filming Score | Ave Spotting Score | Ave Filming Score | Ave Spotting Score |
| Ex. 1 | 1.5 | 3.0 | 2.5 | 1.5 |
| Comp. Ex. 2 | 4.0 | 3.0 | 4.0 | 2.0 |
| Comp. Ex. 3 | — | — | 4.0 | 3.0 |
| Comp. Ex. 4 | — | — | 3.5 | 3.0 |
| Comp. Ex. 5 | — | — | 4.0 | 3.0 |

For the average spotting scores and average filming scores in Table 4, a spotting score or filming score of 1 indicates that the glasses showed no discernable spotting or no discernable filming, respectively. A spotting score or filming score of 5 indicates the presence of heavy spotting or heaving filming, respectively. As shown by the results in Table 4, the dishwasher composition of Example 1 resulted in a significantly lower average spotting score and average filming score compared to the spotting scores and filming scores of the commercially available dishwasher gels of Comparative Examples 2-5. These superior results for the dishwasher composition of Example 1 were obtained even though the specific gravity and percent solids of the dishwasher composition of Example 1 was less than the specific gravities and percent solids for each of the commercially available dishwasher gels of Comparative Examples 2-5.

Example 7: Dishwasher Composition for Evaluation of Cleaning Performance

In Example 7, the cleaning performance of the dishwasher composition was evaluated. The formulation for the dishwasher composition of Example 7 is provided below in Table 5. The dishwasher composition of Example 7 was prepared using the method previously described in relation to Example 1. The weight percentages in Table 5 below are provided on a total solution basis (i.e. the commercial chemical as received including the active constituents as well as solvents, diluents, additives, etc.)

TABLE 5

Formulation of the Dishwasher Composition of Example 7

| Constituent of Dishwasher Composition | wt. %* |
|---|---|
| Preservative (KATHON ™ CG preservative from DOW) | 0.0375 |
| Structuring Agent (xanthan gum (TN grade) from Jungbunzlauer, Inc.) | 0.75 |
| Weak Chelant (sodium citrate dehydrate) | 6.42 |
| pH Adjuster (citric acid anhydrous) | 1.05 |
| Strong Chelant (GLDA - DISSOLVINE ® GL-47-S from Nouryon) | 12.0 |
| Surfactant (PLURAFAC ® SLF180 surfactant from BASF) | 2.0 |
| Anti-Spotting Polymer (ACUSOL ™ 460N Liquid from Dow) | 0.20 |
| Detersive Polymer (ACUSOL ™ 588N acrylic/sulphonic acid copolymer liquid from DOW) | 0.70 |
| Secondary Preservative (sodium benzoate) | 0.4 |
| Fragrance | 0.12 |
| Protease Enzyme (Blaze Pro 100 protease enzyme from Novozymes) | 0.603 |
| Amylase Enzymes (Achieve Alpha 100 L amylase from Novozymes) | 0.203 |
| Purified Water | Balance to 100 |

*Weight percentages are on a total solution basis (i.e., weight of active material and solvent/diluent divided by the total weight of the dishwasher composition).

Comparative Example 8: Leading National Brand Dishwasher Gel

For Comparable Example 8, a sample of a leading National brand of dishwasher gel was obtained to provide a standard for cleaning performance against which to compare the cleaning performance of the dishwasher composition of Example 7. The leading National brand dishwashing gel of Comparative Example 8 was CASCADE® COMPLETE™ brand dishwasher detergent with DAWN®, Citrus Breeze Gel (03000371342) marketed by the Proctor and Gamble Company.

Example 9: Evaluation of the Cleaning Performance of the Dishwasher Composition In Example 9, the cleaning performance of the dishwasher composition of Example 7 was evaluated against the leading National brand dishwasher gel of Comparative Example 8. The dishwasher composition of Example 7 and the leading National brand dishwasher gel of Comparative Example 8 were subjected to a washing study conducted in accordance with the modified IKW method—BUF-WIN-00731 (*Recommendations for the Quality Assessment of the Cleaning Performance of Dishwasher Detergents, Part B*, German Cosmetic, Toiletry, Perfumery and Detergent Association (2015)) to evaluate general soil removal. The IKW washing study was conducted by third party testing company Bureau Veritas in Buffalo, N.Y. The results of the washing study along with the percent solids for the dishwasher composition of Example 7 and the leading National brand dishwasher gel of Comparative Example 2 are provided below in Table 6. The percent solids for each composition of Example 7 and Comparative Example 8 was determined by method CPSD-HL-01056-MTHD. The cleaning performance results in Table 6 represent the simple average of measurements taken for two runs.

TABLE 6

Results of the Washing Studies of Example 9

| Attribute | Criteria | Comp. Ex 8 | Ex. 7 |
|---|---|---|---|
| Percent Solids | Wt. % | 33.6 | 17.0 |
| Tea in cups | Visual evaluation 1-10 | 7.5 | 7.4 |
| Pasta dried on porcelain plates soaked in iodine solution | Visual evaluation 1-10 | 7.5 | 7.9 |
| Milk in microwave in glass beakers | Visual evaluation 1-10 | 7.7 | 7.3 |
| Starch mix on glass plate soil evaluation | Visual evaluation 1-10 | 6.2 | 6.8 |
| Egg yolk on stainless steel | Percent soil removed | 57.6 | 53.1 |
| Egg yolk on stainless steel | Visual evaluation 1-10 | 6.7 | 5.8 |
| Minced meat on porcelain plates | Visual evaluation 1-10 | 5.2 | 5.2 |
| Crème brule on porcelain plates | Visual evaluation 1-10 | 6.7 | 6.6 |

The results in Table 6 indicate that the cleaning performance of the dishwasher composition of Example 7 is comparable to the leading National brand dishwasher gel of Comparative Example 8. This shows that the dishwasher compositions of the present disclosure may reduce filming and spotting caused by scale deposits while still maintaining a high level of cleaning performance comparable to leading National brand dishwasher detergent products.

It should be understood that any two quantitative values assigned to a property may constitute a range of that property, and all combinations of ranges formed from all stated quantitative values of a given property are contemplated in this disclosure. It should be appreciated that compositional ranges of a chemical constituent in a composition or formulation should be appreciated as containing, in some embodiments, a mixture of isomers of that constituent. It should be appreciated that the examples supply compositional ranges for various compositions, and that the total amount of isomers of a particular chemical composition can constitute a range.

Further, it should be apparent to those skilled in the art that various modifications and variations can be made to the described embodiments without departing from the spirit and scope of the claimed subject matter. Thus it is intended that the specification cover the modifications and variations of the various described embodiments provided such modification and variations come within the scope of the appended claims and their equivalents.

What is claimed is:

1. A dishwasher composition comprising:

at least one strong chelant, at least one weak chelant, at least one surfactant, at least one enzyme, and one or more enzyme stabilizing additives comprising a tripeptide inhibitor(s), 4-formyl, phenyl boronic acid, or both;

wherein the dishwasher composition is a liquid or a gel having a pH of from 7.0 to 9.5, and the dishwasher composition includes less than 0.5 wt. % silicates based on the total weight of the dishwasher composition.

2. The dishwashing composition of claim 1, wherein the at least one enzyme comprises one or a plurality of hydrolase enzymes.

3. The dishwashing composition of claim 2, wherein the one or a plurality of hydrolase enzymes comprises one or more hydrolase selected from the group consisting of protease, amylase, mannanase, lipase, pectinase, or combinations of these.

4. The dishwasher composition of claim 2, wherein the one or a plurality of hydrolase enzymes comprises at least one protease enzyme and at least one amylase enzyme.

5. The dishwasher composition of claim 1, further comprising a detersive polymer, the detersive polymer comprising a copolymer or terpolymer of sulfonate containing monomers and carboxylate containing monomers, wherein the detersive polymer comprises from 10 wt. % to 50 wt. % sulfonic acid monomer units, sulfonate containing monomer units, or both.

6. The dishwasher composition of claim 1, wherein the at least one strong chelant—one or more than one of L-glutamic acid N,N-diacetic acid (GLDA), methylglycine diacetic acid (MGDA), ethylene diamine tetraacetic acid (EDTA), and iminodisuccinic acid (IDS), metal salts thereof, or combinations thereof.

7. The dishwasher composition of claim 1, wherein the at least one weak chelant comprises at least one of citric acid, sodium citrate, sodium citrate dihydrate, malic acid or a metal salt thereof, gluconic acid or a metal salt thereof, ethylenediamine-N,N-disuccinic acid (EDDS) or a metal salt thereof, or combinations thereof.

8. The dishwasher composition of claim 1, further comprising a detersive polymer comprising one or more different monomers derived from the acid form or neutralized form of one or more of acrylic acid, maleic acid, methacrylic acid, itaconic acid, t-butyl acrylamide, aspartic acid, 2-acrylamido-2-methyl-propane sulfonic acid, sulfonated styrene, and combinations thereof, wherein the detersive polymer has a weight average molecular weight of less than or equal to 15,000 g/mol.

9. The dishwasher composition of claim 8, wherein the detersive polymer has a phosphono end group on the molecule.

10. The dishwasher composition of claim 1, further comprising an anti-spotting polymer comprising a copolymer of diisobutylene and maleic acid.

11. The dishwasher composition of claim 1, wherein the dishwasher composition comprises up to 5 wt. % metal alkali salts of carbonate, up to 15% of alkali metal salts of bicarbonate, up to 15% sodium sulfate, up to 15% sodium chloride, or combinations of these based on the total weight of the dishwasher composition.

12. The dishwasher composition of claim 1, wherein the dishwasher composition is substantially free of phosphorous-containing compounds.

13. The dishwasher composition of claim 1, further comprising one or more phosphonate containing compounds comprising one or more of 1-hydroxyethylidene 1,1-diphosphonic acid, 2-phosphonobutane-1,2,4,-tricarboxylic acid, amino tris (methylene phosphonic acid), metal salts thereof, or combinations of these.

14. The dishwasher composition of claim 1, further comprising one or more structuring constituents selected from xanthan gum, guar gum, cellulosic thickeners, cross-linked polyacrylate structurants, or combinations of these.

15. The dishwasher composition of claim 1, further comprising one or more preservative constituents operable to prevent microbial spoilage.

16. The dishwasher composition of claim 1, comprising a specific gravity of 1.03 to 1.25.

17. The dishwasher composition of claim 1, comprising:

from 1 wt. % to 30 wt. % strong chelant;

from 3 wt. % to 20 wt. % weak chelant;

from 0.1 wt. % to 6.0 wt. % enzymes;

from 1.0 wt. % to 10.0 wt % surfactant;

optionally, from 0.1 wt. % to 10.0 wt. % detersive polymer;

optionally, from 0.1 wt. % to 3.0 wt. % structuring constituent; and water.

18. A method of washing articles, the method comprising:

forming a washing solution in a washing machine, the washing solution comprising water and a dishwasher composition, the dishwasher composition comprising:

at least one strong chelant, at least one weak chelant, a structural constituent, at least one surfactant, at least one enzyme comprising one or a plurality of hydrolase enzymes, and one or more enzyme stabilizing additives comprising a tripeptide inhibitor(s), 4-formyl, phenyl boronic acid, or both;

wherein the dishwasher composition is a liquid or a gel having a pH of from 7.0 to 9.5, and the dishwasher composition includes less than 0.5 wt. % silicates based on the total weight of the dishwasher composition; and contacting at least one article with the washing solution during at least a portion of a wash cycle of a commercially-available dishwasher.

19. The method of claim 18, wherein the water has a hardness of from 100 mg/L to 325 mg/L.

20. A dishwasher composition comprising:

at least one strong chelant, at least one weak chelant, at least one surfactant, at least one enzyme, and at least one detersive polymer comprising a structure with carboxymethyl inulin;

wherein the dishwasher composition is a liquid or a gel having a pH of from 7.0 to 9.5, and the dishwasher composition includes less than 0.5 wt. % silicates based on the total weight of the dishwasher composition.

* * * * *